US009222354B2

(12) United States Patent
Allgaier et al.

(10) Patent No.: US 9,222,354 B2
(45) Date of Patent: Dec. 29, 2015

(54) TOOL SYSTEM

(71) Applicants: Betek GmbH & Co. KG, Aichhalden (DE); Wirtgen GmbH, Windhagen (DE)

(72) Inventors: Thomas Allgaier, Schramberg-Sulgen (DE); Thomas Lehnert, Oberraden (DE); Markus Roth, Aichhalden (DE)

(73) Assignee: Wirtgen GmbH (DE)

( * ) Notice: Subject to any disclaimer, the term of this patent is extended or adjusted under 35 U.S.C. 154(b) by 0 days.

(21) Appl. No.: 14/347,405

(22) PCT Filed: Oct. 11, 2012

(86) PCT No.: PCT/EP2012/070144
§ 371 (c)(1),
(2) Date: Mar. 26, 2014

(87) PCT Pub. No.: WO2013/053811
PCT Pub. Date: Apr. 18, 2013

(65) Prior Publication Data

US 2014/0217806 A1 Aug. 7, 2014

(30) Foreign Application Priority Data

Oct. 11, 2011 (DE) ..... 10 2011 054 384
Oct. 11, 2011 (DE) ..... 10 2011 054 386
Oct. 11, 2011 (DE) ..... 10 2011 054 393

(51) Int. Cl.
*E21C 35/19* (2006.01)
*E21C 35/197* (2006.01)
*E21C 35/18* (2006.01)

(52) U.S. Cl.
CPC ..... *E21C 35/197* (2013.01); *E21C 35/18* (2013.01); *E21C 35/19* (2013.01)

(58) Field of Classification Search
CPC ..... E21C 35/19; E21C 35/197
USPC ..... 299/106, 107, 110
See application file for complete search history.

(56) References Cited

U.S. PATENT DOCUMENTS 3,830,546 A 8/1974 Kniff
4,149,753 A 4/1979 Stoltz et al.
(Continued)

FOREIGN PATENT DOCUMENTS

CN 201474694 U 5/2010
DE 1923922 11/1970
(Continued)

OTHER PUBLICATIONS

International Search Report in corresponding International Application No. PCT/EP2012/070144, dated Feb. 6, 2014, 3 pp. (not prior art).
(Continued)

*Primary Examiner* — David Bagnell
*Assistant Examiner* — Michael Goodwin
(74) *Attorney, Agent, or Firm* — Lucian Wayne Beavers; Patterson Intellectual Property Law, PC

(57) ABSTRACT

The invention relates to a tool system having a bit holder and a shank bit, the bit holder comprising a bit receptacle that comprises a first and a second diameter region that lead into one another via a transitional segment (taper), a bit shank of the shank bit comprising a first and a second cross-sectional region that lead into one another via a transitional segment. With a tool system of this kind, a wear-optimized design results from the fact that the transitional segments of the shank bit and of the bit holder are arranged spaced away from one another in the direction of the longitudinal center axis of the shank bit, in order to form a resetting space.

18 Claims, 7 Drawing Sheets

(56) References Cited

U.S. PATENT DOCUMENTS

| | | | | |
|---|---|---|---|---|
| 4,327,947 | A | 5/1982 | Bower, Jr. | |
| 4,488,759 | A | 12/1984 | Bergqvist | |
| 4,575,156 | A | 3/1986 | Hunter et al. | |
| 4,632,463 | A | 12/1986 | Sterwerf, Jr. | |
| 4,678,238 | A | 7/1987 | Emmerich | |
| 5,730,502 | A * | 3/1998 | Montgomery, Jr. | 299/104 |
| 6,113,195 | A | 9/2000 | Mercier et al. | |
| 6,851,758 | B2 | 2/2005 | Beach | |
| 8,573,706 | B2 * | 11/2013 | Parrott et al. | 299/81.3 |
| 2004/0118615 | A1 | 6/2004 | Beach | |
| 2005/0146198 | A1 | 7/2005 | Hill et al. | |
| 2006/0125308 | A1 | 6/2006 | Sollami | |
| 2008/0030065 | A1 | 2/2008 | Frear | |
| 2010/0148568 | A1 * | 6/2010 | Latham | 299/111 |
| 2010/0244545 | A1 | 9/2010 | Hall et al. | |
| 2011/0175430 | A1 | 7/2011 | Heiderich et al. | |
| 2011/0193399 | A1 | 8/2011 | Monyak et al. | |

FOREIGN PATENT DOCUMENTS

| | | | |
|---|---|---|---|
| DE | 2630276 | A1 | 1/1978 |
| DE | 3307895 | A1 | 9/1983 |
| DE | 9411438 | U1 | 11/1994 |
| DE | 19630642 | A1 | 2/1998 |
| DE | 10325253 | A1 | 12/2004 |
| DE | 102005001535 | B3 | 8/2006 |
| DE | 102009027732 | A1 | 1/2011 |
| EP | 0412287 | A2 | 2/1991 |
| FR | 2522578 | A1 | 9/1983 |
| WO | 2009003561 | A1 | 1/2009 |
| WO | 2013053813 | A2 | 4/2013 |

OTHER PUBLICATIONS

International Search Report in corresponding International Application No. PCT/EP2012/070146, dated Feb. 6, 2014, 3 pp. (not prior art).

International Search Report in corresponding International Application No. PCT/EP2012/070147, dated Feb. 6, 2014, 3 pp. (not prior art).

U.S. Appl. No. 14/347,409, filed Oct. 11, 2012 to Roth et al. (not prior art).

U.S. Appl. No. 14/347,410, filed Oct. 11, 2012 to Roth et al. (not prior art).

Office Action in co-pending U.S. Appl. No. 14/347,410 dated Feb. 13, 2015, 14 pp. (not prior art).

* cited by examiner

TOOL SYSTEM

The invention relates to a tool system having a bit holder and a shank bit, the bit holder comprising a bit receptacle that comprises a first and a second diameter region that lead into one another via a transitional segment, and a bit shank of the shank bit comprising a first and a second cross-sectional region that lead into one another via a transitional segment.

A tool system of this kind is known from DE 33 07 895 A1. It is used for working seams in mining, but also for working ground surfaces, for example road surfaces. The shank bit comprises a bit head and a bit shank connected thereto. The bit shank is secured, in axially lossproof fashion and freely rotatably around its longitudinal center axis, in the bit receptacle of the bit holder. A securing ring that is inserted into a circumferential groove of both the bit shank and the bit holder is used here. The bit shank comprises a first cylindrical segment and, adjacent thereto, a second cylindrical segment. The two cylindrical segments lead into one another via a transitional segment. The circumferential groove for the securing element is recessed in the region of the second cylindrical segment. The bit holder is equipped in the region of the bit receptacle with two coaxial bores of different diameters corresponding to the bit shank. These two bores likewise lead into one another via a transitional segment. The shank bit is held within the bit receptacle with a small axial clearance. A valve element that is installed in the bit holder presses with a plunger onto the free shank end of the shank bit. The result is that the shank bit is held in a first preload position in which a support surface of the bit head is spaced away from a countersurface of the bit holder. When the shank bit is then slid axially into the bit holder, the valve element is actuated and a purging device is triggered. In the slid-in state, the two transitional segments of the bit receptacle and of the shank bit sit on one another. This operating state occurs when the shank bit comes into contact with the substrate to be worked. The shank bit then also rotates inside the bit receptacle, in which context on the one hand the two transitional segments abrade against one another and on the other hand the bit head abrades with its support surface on the countersurface of the bit holder. The consequence of these motions is to wear away the bit holder, quickly resulting in functional failure of the overall system. In particular, the shank bit can abrade in so that it jams in the bit receptacle and is then no longer freely rotatable. The consequence of this is that the shank bit becomes unevenly worn, and thus cannot be used optimally over its entire wear life.

A similar tool configuration is known from DE 26 30 276.

For the purpose of wear-optimized design of the tool system, it is necessary for the tool holder to last through the service life of a plurality of shank bits.

An object of the invention is to make available a tool system of the kind recited initially that is designed in wear-optimized fashion.

This object is achieved in that the transitional segments of the shank bit and of the bit holder are arranged spaced away from one another in the direction of the longitudinal center axis of the shank bit, in order to form a resetting space.

Unlike in the existing art according to DE 33 07 895 A1, the invention takes a different approach according to which the transitional segments are no longer superposed in the axial direction but instead are spaced away from one another. With this tool system, the unavoidable wear of the bit holder as a result of rotation of a support surface of the shank bit is likewise produced on a countersurface of the bit holder. This results in longitudinal wear on the bit holder. As a result of the spacing of the transitional segments, the shank bit can continuously and increasingly seat into the bit receptacle. The resetting space ensures here that the transitional segments do not come into contact. The free rotatability of the shank bit is thus maintained. A plurality of shank bits can thus be utilized on the bit holder before the bit holder reaches its wear limit. This wear limit can then be defined, for example, by the fact that after a plurality of bit changes, the outer contour of the bit holder is worn away because of the aggressive attack of removed material, or that the transitional segments are finally resting on one another due to substantial longitudinal wear on the bit holder.

According to a preferred variant of the invention, provision is made that the bit holder comprises an abutting surface on which the shank bit is indirectly or directly braced with a support surface of its bit head. The bit head is placed in defined fashion on the support surface during operational use, and in this functional position the transitional segments are spaced away from one another. The longitudinal wear on the bit holder is thus generated at a predefined site. The bit head can be braced over a large area with respect to the bit holder, so that stable energy dissipation becomes possible. The bit head can be placed directly on the bit holder, or it is conceivable for the bit head to be supported with respect to the abutting surface of the bit holder with interposition of an element, for example a wear protection disk.

In order to obtain reliable rotational support, according to a variant of the invention provision can be made that the first and the second cross-sectional region of the bit shank are constituted by a first and a second cylindrical region, the first cylindrical region having a diameter in the range between 18 mm and 30 mm and an extent in the direction of the longitudinal center axis of the shank bit less than or equal to 30 mm. These dimensions of the first cylindrical region result in stable shank guidance. During working attack, forces act obliquely to the longitudinal center axis of the shank bit. This results in bearing stress in the contact region between the first cylindrical segment and the bit receptacle. The above-described dimensioning of the first cylindrical segment guarantees optimized energy dissipation, the resulting surface pressures being minimized. A low level of frictional wear in the region of those regions of the bit receptacle which form the rotary bearing system is also guaranteed. This type of configuration of a tool system is optimally designed in particular for use in the road construction sector.

According to a preferred variant of the invention, the transitional segments should be arranged spaced away from one another in the range between at least 4 mm and at most 20 mm. With a spacing of 4 mm, sufficient replacement cycles of the shank bit can be achieved when the tool system is used to work a soft substrate. A spacing less than or equal to 20 mm is necessary when a particularly hard substrate, for example a concrete slab, is to be removed.

Particularly preferably, the bit receptacle is constituted by an insert made of hard material. The insert is fastened in an inner receptacle of the bit holder. An insert of this kind guarantees a high level of resistance to frictional wear. It therefore makes possible a plurality of tool change cycles. The bit holder itself can thus be made, in wear- and cost-optimized fashion, from a steel material into which the insert is installed.

Reliable operation of the tool system is achievable in particular when provision is made that a rotary bearing system and/or a slide guide having an action direction in the direction of the longitudinal center axis of the shank bit is constituted with the first cross-sectional region of the bit shank and the first diameter region of the bit receptacle, and/or with the second cross-sectional region of the bit shank and the second diameter region. Reliable rotational behavior of the shank bit can be maintained by way of the rotary bearing system. The slide guide guarantees continuous resetting of the shank bit in the resetting space.

If provision is made that the shank bit comprises a securing element that is adjustable in the direction of the longitudinal center axis of the shank bit along a slide guide of the bit receptacle, this on the one hand makes possible simple assembly and disassembly of the shank bit even in rough use on construction sites. A further result thereof is reliable retention of the shank bit in the bit receptacle.

The slide guide can be constituted by the first and/or the second diameter region of the bit receptacle.

According to a preferred variant of the invention, provision can be made that the securing element comprises a resilient clamping part that at least locally surrounds a bearing receptacle; and that fastening segments that are arranged spaced away from one another in a circumferential direction are indirectly or directly radially externally adjacent to the clamping part. This configuration of a securing element has the advantage, as compared with a securing element having an annular outer contour, that the separate fastening segments can abut better against the inner wall of the bit receptacle, such that, in particular, mounting tolerances or wear-related erosion of the bit receptacle can also be compensated for. The fastening segments act in prong-like fashion and thus guarantee a secure hold. The securing element itself can bring about, with the bearing receptacle of the clamping part, good rotational support of the shank bit.

A tool system according to the present invention can also be characterized in that the bit shank terminates at its free end with a shoulder or similar terminal segment; and that the bit holder comprises, adjacently to the bit receptacle, an opening segment into which the shoulder or similar end segment can reset. The arrangement of the opening segment in the region of the bit holder makes possible a compact design. The shoulder or similar end segment also does not project out of the bit holder when the shank bit resets into the resetting space. The shank bit is thus always accommodated in the bit holder in secured and protected fashion. A further function can be assigned to the opening segment by the fact that it comprises a drive-out opening accessible from the back side of the bit holder. The drive-out opening creates access to the free end of the bit shank. A drive-out tool can thus be set against the shank end, and a worn-out shank bit can be driven out of the bit holder.

A further optimization of the tool system is created by the fact that the bit holder comprises an insertion projection for replaceable installation in a base part. This makes possible further wear optimization in the design of the tool system. The base part can constitute the coupling piece to the rotary member of the road milling machine or similar construction machine. The base part can be designed so that it lasts through several change cycles of a bit holder. This makes possible quick and simple replacement of the bit holder along with the insertion projection. The latter can be clamp-locked, for example with a clamping screw that acts on a support surface of the bit shank, in an insertion receptacle of the base part.

The invention will be explained below in further detail with reference to an exemplifying embodiment depicted in the drawings, in which.

Figure 1:
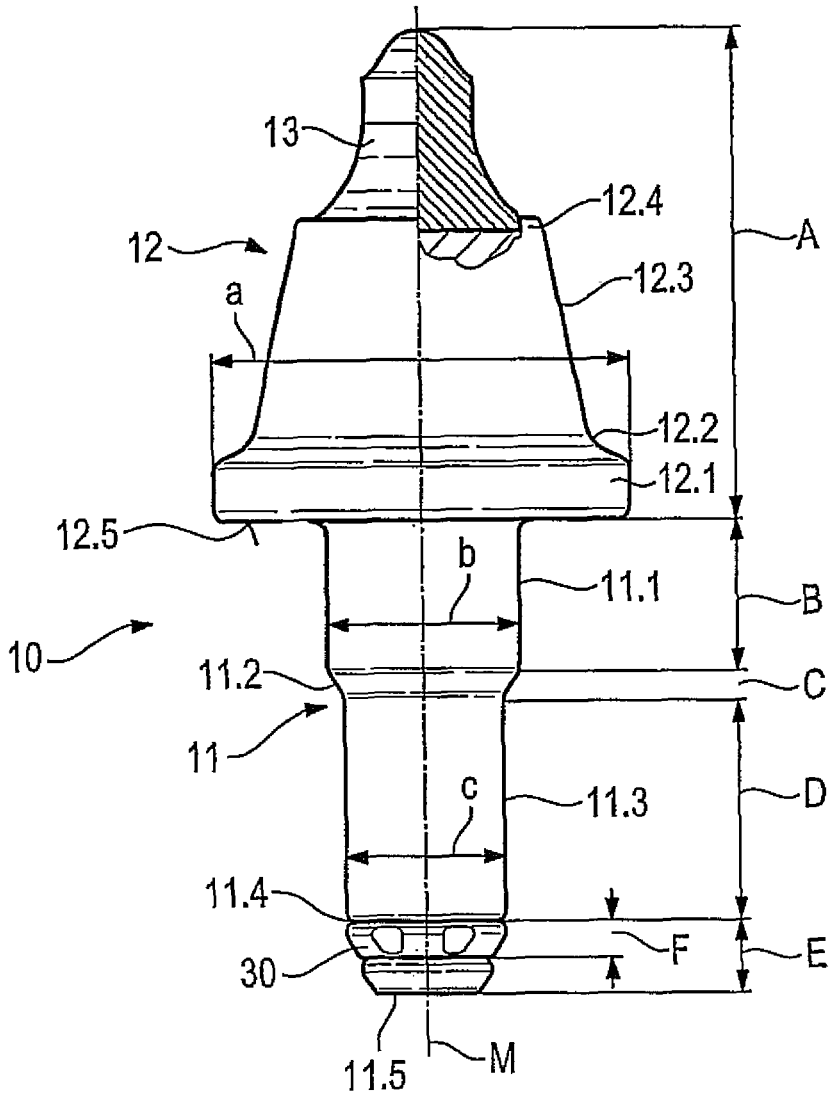
FIG. 1 is a side view and partial section of a shank bit.

FIG. 1 shows a shank bit 10 having a bit shank 11 and a bit head 12 shaped thereon. Bit shank 11 is embodied as a stepped shank, and comprises a first cylindrical segment 11.1 that leads via a frustoconical transitional segment 11.2 into a second cylindrical segment 11.3. A securing receptacle 11.4 in the form of a circumferential groove is provided in the region of second cylindrical segment 11.3. This securing receptacle 11.4 is demarcated at the end by a shoulder 11.5. First cylindrical segment 11.1 is directly adjacent, via a radius transition or alternatively via a frustoconical transitional segment, to a support surface 12.5 of bit head 12. When a frustoconical transitional segment is used, a stress-optimized contour having a conical angle of 45° and an extent in the direction of longitudinal center axis M of bit shank 11 of less than 4 mm has proven advantageous. Support surface 12.5 is embodied annularly, and is constituted by a shoulder-shaped support segment 12.1. Bit head 12, proceeding from support segment 12.1, leads via a taper 12.2 having a concave geometry into a discharge surface 12.3. Discharge surface 12.3 is embodied frustoconically in the present case, but can also be, for example, of cylindrical or concave configuration. At its end facing away from bit shank 11, bit head 12 carries a cutting element 13 in a cutting element receptacle 12.4. Cutting element 13 is made of a hard material, for example of hard metal, and is soldered into cutting element receptacle 12.4.

The component extents of shank bit 10 in the direction of longitudinal center axis M of shank bit 10 are noted in FIG. 1. Specifically, bit head 12, including cutting element 13, has a head length A that is in the range between 35 mm and 60 mm. First cylindrical segment 11.1 has an extent B in the direction of longitudinal center axis M of the bit shank ≤30 mm. An extent of 15 mm is selected in the present case. The length of the transitional segment is labeled C, and should be <10 mm. An extent of approx. 3 mm is selected in the present case. The length of second cylindrical segment 11.3 is noted as D, and has an extent in the direction of longitudinal center axis M in the range between 10 and 40 mm. The length of terminal segment E, encompassing securing receptacle 11.4 and shoulder 11.5, should be a minimum of 3 mm. A dimension of 7 mm is selected in the present case, the groove width F of securing receptacle 11.4 being approx. 3 mm.

Dimensions are further provided in FIG. 1 for outside diameter a of support surface 12.5, diameter b of first cylindrical segment 11.1, and diameter c of second cylindrical segment 11.3. Diameter b of first cylindrical segments 11.1 is in the range between 18 mm and 30 mm. Diameter c of second cylindrical segment 11.3 is selected in the range between 14 mm and 25 mm. Outside diameter a of support surface 12.5 is in the present case between 30 mm and 46 mm, and is selected particularly preferably in the range between 40 mm and 44 mm.

Figure 3:
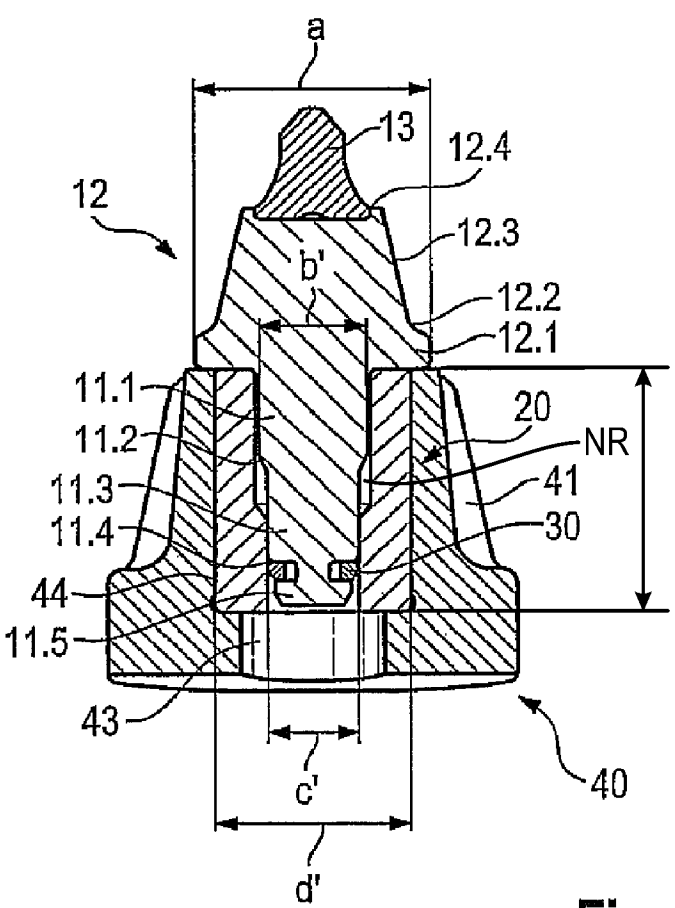
FIG. 3 is a vertical section showing a detail of the depiction of FIG. 2.
Figure 2:
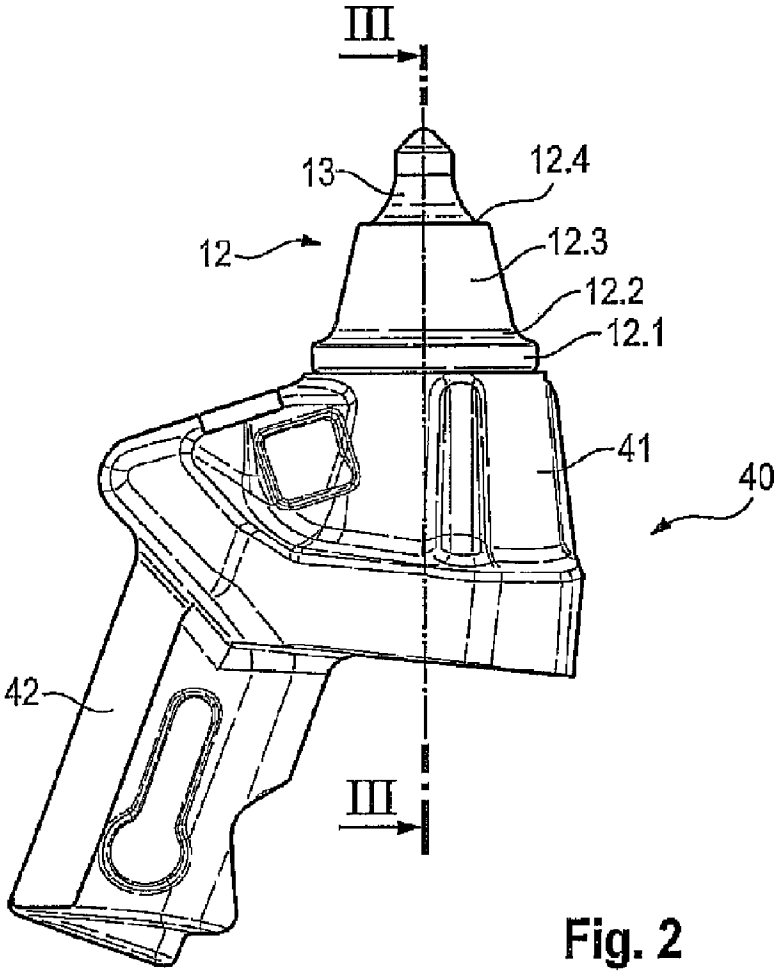
FIG. 2 is a side view showing a combination made up of a bit holder and the shank bit shown in FIG. 1.

FIG. 2 shows a bit holder 40 that is utilized to receive shank bit 10 according to FIG. 1. Bit holder 40 comprises a base part onto which a projection 41 and an insertion projection 42 are integrally shaped. As FIG. 3 shows, projection 41 is equipped with a cylindrical inner receptacle 44 into which an insert 20 made of hard material, in particular of hard metal, is inserted. Insert 40 is embodied in the form of a sleeve, and has a cylindrical outer geometry that is adapted to inside diameter d' of inner receptacle 44 in such a way that upon installation of insert 20 into bit holder 40, a press fit results (interference fit). The inserting motion of insert 20 into inner receptacle 44 is limited by a setback. The setback is embodied in the transitional region of inner receptacle 44 to a drive-out opening 43 embodied as a bore. Inner receptacle 44 and drive-out opening 43 are coaxial with one another. Insert 20 has a stepped bore that comprises a first diameter region 21 and a second diameter region 23. The two diameter regions 21, 23 are guided into one another via a taper 22. Taper 22 has a frustoconical geometry. As is evident from FIG. 3, inside diameter c' of the second diameter region is selected to be smaller than the inside diameter of drive-out opening 43. This results in a drive-out shoulder on insert 20. Insert 20 can thus be ejected as necessary from bit holder 40 by means of a tool introduced through drive-out opening 43 and set against the drive-out shoulder.

Figure 11:
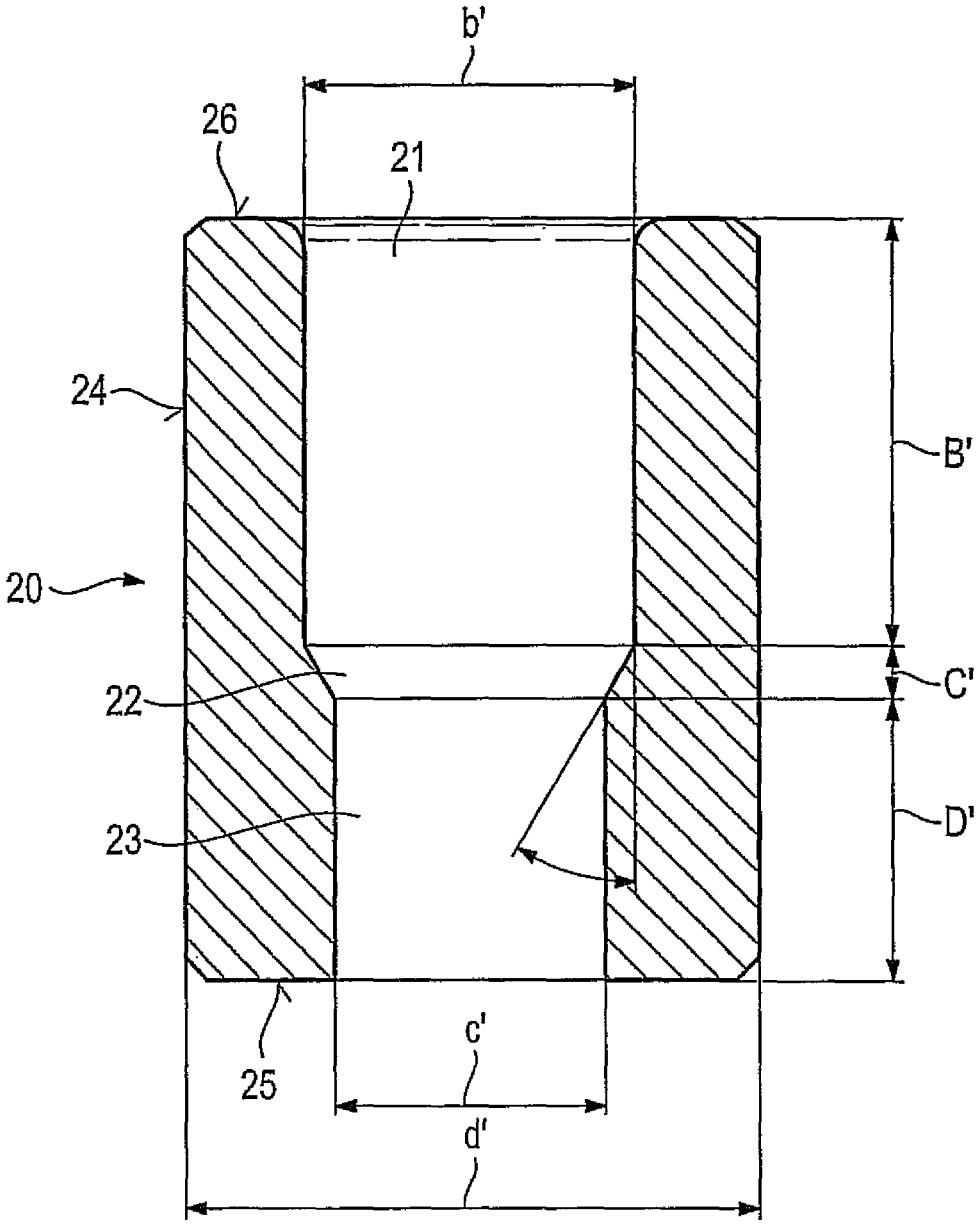
FIG. 11 is a side view and vertical section showing an insert for installation in the bit holder according to FIGS. 2 and 3.

The configuration of insert 20 is detailed further in FIG. 11. As this drawing shows, the external geometry of insert 20 is constituted by a fit surface 24 that, as described above, forms a snug fit with inner receptacle 44. Transversely to the longitudinal center axis of insert 20, insert 20 possesses a lower abutment surface 25 that, in the installed state, comes to a stop against a countersurface of inner receptacle 44, as shown in FIG. 3. An exact association of insert 20 with bit holder 40 is thereby enabled. Insert 20, facing away from abutment surface 25, abuts with an abutting surface 26 flush against an adjoining end face of bit holder 40, as likewise illustrated in FIG. 3. First diameter region 21 of insert 20 has a diameter b', and second diameter region 23 has a diameter c'. Diameters b' and c' are designed in a manner adapted to diameters b and c of the respective first and second cylindrical segments 11.1 and 11.3 of bit shank 22. The association of shank bit 10 with insert 20 is ensured here, with little clearance, in such a way that shank bit 10 remains freely rotatable around its longitudinal central axis M. The extent of first diameter region 21 in the direction of longitudinal central axis M is B'; as FIG. 3 clearly indicates, this extent B' is greater than the extent b of first cylindrical segment 11.1.

The extent of second diameter region 23 is labeled D' in FIG. 11, and the extent of taper region is labeled C'. Extent D' is selected so that bit shank 11 is received entirely within insert 20, as is apparent from FIG. 3.

Figure 4:
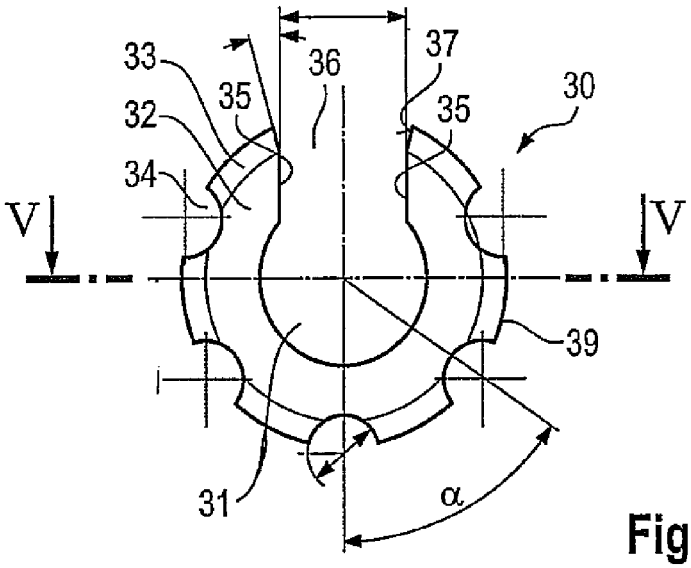
FIG. 4 is a plan view of a securing element.

As mentioned earlier, a securing receptacle 11.4 in the form of a circumferential groove is provided in the region of bit shank 11. A securing element 30 is received in this groove, as shown in further detail in FIGS. 4 to 6. As these drawings show, securing element 30 possesses a partially annular circumferential clamping part 32, radially externally adjacent to which are fastening segments 33, which in the present case are embodied in the form of a chamfer as cross-sectional reductions. The cross-sectional reductions are interrupted by recesses 34 which extend into clamping part 32. The result is to form prong-shaped radially external holding segments 39 in the form of curved regions spaced away from one another at an angle α preferably from 50° to 70°, in the present case 60°. These convex curved regions serve to clamp securing element 30 in place in second diameter region 23 of insert 20, as shown in FIG. 3. Clamping part 32 surrounds a bearing receptacle 31 that, together with the groove base of securing receptacle 11.4, forms a rotary bearing system. This bearing receptacle 31 opens into a slot that forms an introduction opening 36. Introduction opening 36 is demarcated by two rims 35 that open out into introduction chamfers 37. Introduction chamfers 37 are arranged so that they widen into introduction opening 36.

Figure 5:
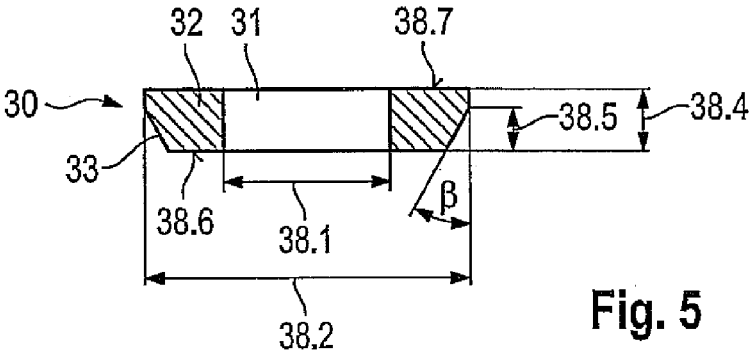
FIG. 5 is a side view, and a section V-V according to FIG. 4, showing the securing element according to FIG. 4.
Figure 6:
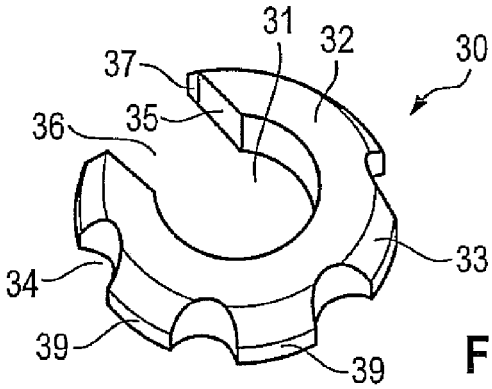
FIG. 6 is a perspective depiction of the securing element according to FIGS. 4 and 5.
Figure 7:
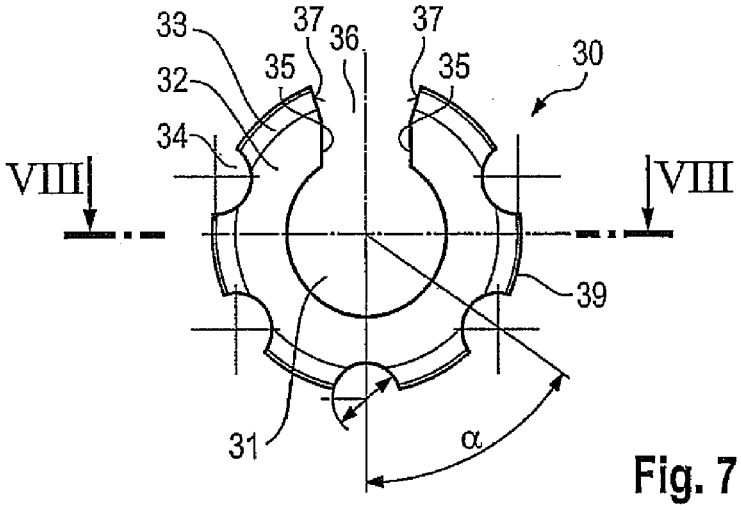
FIG. 7 is a plan view showing a further variant embodiment of a securing element.

As is evident from FIG. 5, bearing receptacle 31 has an inside diameter 38.1, and fastening segments 33 define an outside diameter 38.2. Securing element 30 has an overall height 38.4 that is less than the width of the groove-shaped securing receptacle 11.4. Fastening segments 33 extend over a segment height 38.5, and define an inclination angle β.

FIGS. 7 to 10 show a further variant configuration of a securing element 30. In these Figures, identical reference characters refer to corresponding elements already described with reference to FIGS. 4 to 6, and reference may be made to the previous statement in order to avoid repetition. Securing element 30 again comprises a bearing receptacle 31 that is radially accessible via an introduction opening 36. Introduction opening 36 is demarcated by a rim 35, and rim 35 leads into introduction chamfers 37. In contrast to the embodiment according to FIGS. 4 to 6, securing element 30 is produced in the form of a stamped and bent part in which no material-removing machining or similar reshaping work is necessary in order to constitute fastening segment 33 that is angled with respect to clamping part 32. Correspondingly, for production of securing element 30, firstly a disk-shaped cross section is stamped out, and that is then reshaped, in a bending step, into the configuration visible in FIG. 8.

Figure 8:
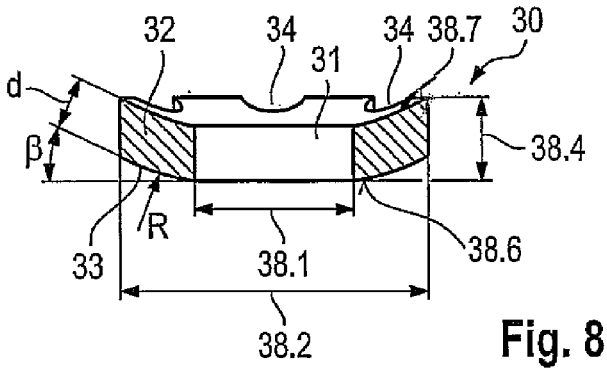
FIG. 8 shows the securing element according to FIG. 7 along the section marked VIII-VIII in FIG. 7.
Figure 9:
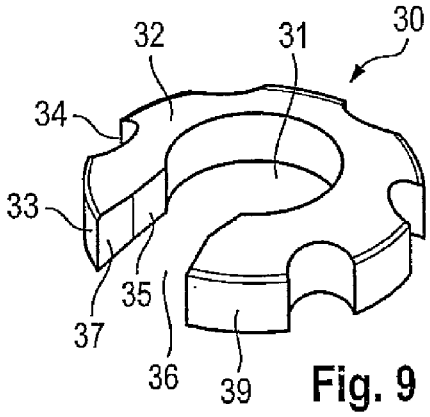
FIGS. 9 and 10 are perspective views of the securing element according to FIGS. 7 and 8.
Figure 10:
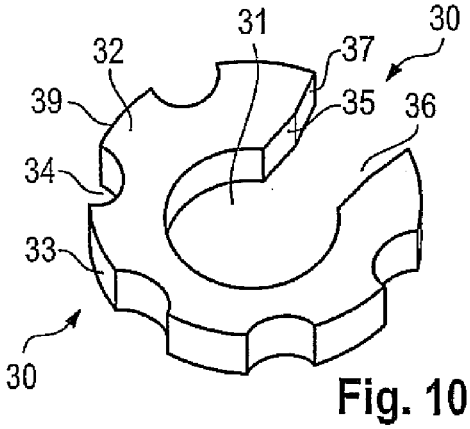

As is evident from FIG. 8, outside diameter 38.2 of securing element 30 is arranged concentrically with the wall (inside diameter 38.1) forming bearing receptacle 31. To achieve this concentricity, either the outer contour of securing element 30 can be reworked, or the stamping die can already be configured so that concentricity is achieved after the concluding bending step.

It is further evident from FIG. 8 that thickness d of securing element 30 is selected to be approximately the same both in the region of clamping part 32 and in the region of fastening segment 33. Fastening segment 33 forms on its underside a convex bulge having a radius R, thus resulting in a surface inclined with respect to the longitudinal center axis of securing element 30, which surface facilitates installation of securing element 30 in insert 20 of bit holder 40, as will be explained in further detail below.

Securing element 30 is concavely indented in the region of its upper side. This results in the formation of linear or narrow strip-shaped abutting regions 38.7 that serve for better rotational behavior of securing element 30 with respect to shank bit 10, as will be explained in further detail below. Recesses 34 are once again recessed in partially circular fashion into fastening segment 33, and extend into the region of clamping part 32.

For installation of securing element 30 on shank bit 10, the latter is firstly placed with introduction chamfers 37 on the groove base of securing receptacle 11.4. Bit shank 11 can then be slid into bearing receptacle 31 by means of a radial pressure, the rotary bearing system then being formed between the groove base of securing receptacle 11.4 and bearing receptacle 31. Securing element 30 expands radially upon insertion of bit shank 11, and once bit shank 11 has passed rims 35, securing element 30 snaps back into its original shape so that bit shank 11 latches into bearing receptacle 31. A lossproof connection of securing element 30 to shank bit 10 is thereby achieved. The unit made up of shank bit 10 and securing element 30 can then be slid into insert 20 of bit holder 40. For this, fastening segments 33 that face toward the free end of bit shank 11 are set onto taper 22. Because of the inclined embodiment of fastening segments 33, as shank bit 10 is slid in, securing element 30 becomes compressed radially inward and can thus be slid into second diameter region 23. Securing element 30 is thereby clamped against the inner wall of second diameter region 23. The deformation of securing element 30 is such that the free rotatability of bit shank 11 is maintained. Securing element 30 reliably braces with its holding segments 39 in second diameter region 23 in the region of fastening segments 33. The insertion motion of shank bit 10 into insert 20 is limited by support surface 12.5 of bit head 12. The latter comes to a stop against abutting surface 26 of insert 20, as shown in FIG. 3.

Shank bit 10 rotates in bearing receptacle 31 during operational use, and bit head 12 abrades with its support surface 12.5 against abutting surface 26 of insert 20. Because insert 20 is made of a hard material and bit head 12 is produced from a material that is softer relative thereto, only a small amount of wear occurs on bit holder 40. Shank bit 10, in contrast, is relatively more severely worn away in the region of its support surface 12.5. What results is a wear system in which the expensive bit holder 40 is worn away less than shank bit 10. A plurality of shank bits 10 can thus be used on one bit holder 40 before the latter reaches its wear limit.

Two wear effects occur, as indicated above, when shank bit 10 abrades away in the region of its support surface 12.5. On the one hand, the overall height of support segment 12.1 becomes reduced. On the other hand, abutting surface 26 of insert 20 is also worn away. As a result of these effects, bit shank 11 continuously recedes in the direction of its longitudinal center axis M into insert 20. First cylindrical segment 11.1 correspondingly slides along first diameter region 21, and securing element 30 along second diameter region 23. Free rotatability of shank bit 10 around its longitudinal center axis M is guaranteed by the use of a resetting space NR. This resetting space NR is shown in FIG. 3. It is created by the fact that the axial length of first cylindrical segment 11.1 is less than the axial longitudinal extent of first diameter region 21. In order to allow bit holder 40 having insert 20 to be utilized in wear-optimized fashion over its maximum possible service life, the axial extent of resetting space NR should be selected in the range between 4 mm and 20 mm.

With the geometrical relationships indicated, it is thus possible to go to the lower limit range of 4 mm when the substrate to be worked is fairly soft. Greater lengths for resetting space NR are better suited for hard ground. In road construction, where mixed concrete and asphalt need to be worked, a length of the resetting space from 7 mm to 20 mm has proven suitable.

In order to ensure secure retention of shank bit 10 over the entire service life of bit holder 40 in the context of the above-described wear system, second diameter region 23 of insert 20 is also dimensioned, in terms of its axial extent, so that securing element 30 can slide in an axial direction against the inner wall of second diameter region 23 in order to compensate for the longitudinal wear of insert 20 and of bit head 12. The axial length of the second diameter region must therefore be correspondingly adapted to the dimensions of resetting space NR. Applied to the dimensioning specifications above, second diameter region 23 must therefore have an axial length of at least 4 mm to 20 mm, plus twice a retention length for the securing element (position of securing element 30 in the unworn and worn state of bit holder 40). The retention length should be a minimum of 2 mm.

As is evident from FIG. 3, in the interest of a compact configuration the terminal shoulder 11.5 can be reset into the region of an opening segment that forms drive-out opening 43. The axial length of the opening segment is to be dimensioned accordingly.

During operational use, bit shank 11 slides with its first cylindrical segment 11.1 against the associated inner surface of first diameter region 21. Because, here as well, insert 20 is made of a hard material and bit shank 11 is made of a softer material, only a small amount of wear is caused here on insert 20 and thus on bit holder 40.

Securing element 30 as shown in FIGS. 7 to 10 is braced with its abutting regions 38.6 and 38.7, in linear or annular fashion with little radial extent, with respect to the groove walls of securing receptacle 11.4, so that good rotation behavior is achieved.

Once shank bit 10 is worn out, it can be removed. For this, a drive-out force is introduced by means of a suitable drive-out tool into the free end of bit shank 11 in the region of shoulder 11.5. Shank bit 10 with its securing element 30 then slides over second diameter region 23 until it springs back radially in the region of first diameter region 21. Shank bit 10 can then be freely removed.

Figure 12:
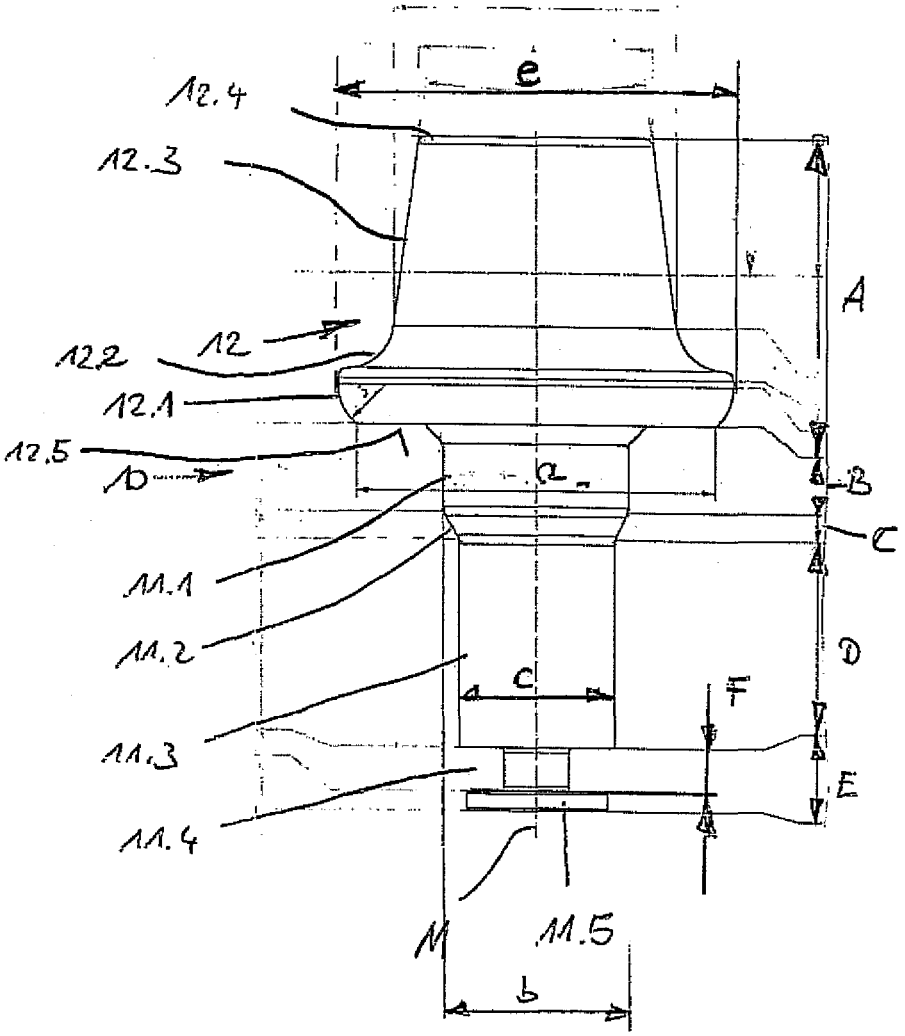
FIG. 12 is a side view of an alternative variant embodiment of a shank bit.
Figure 13:
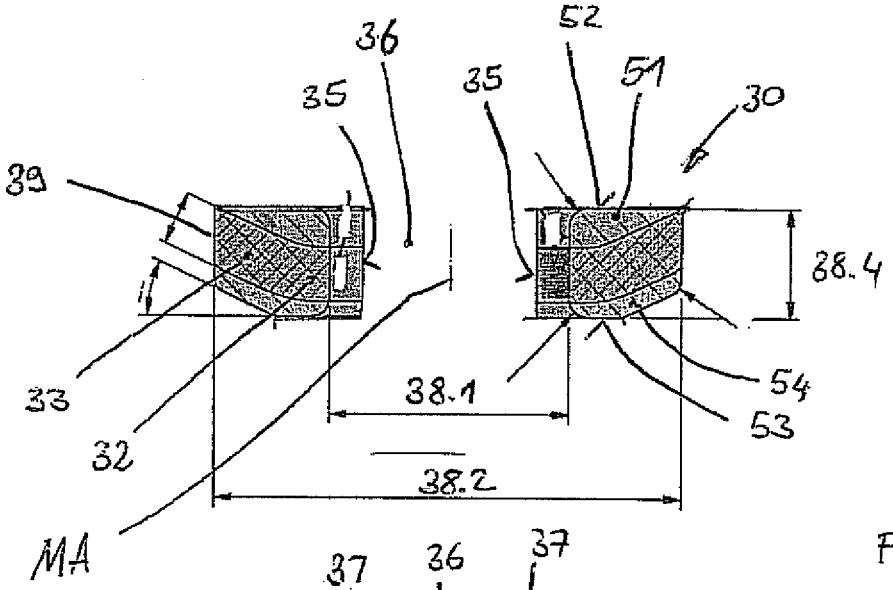
FIG. 13 shows a securing element for the shank bit according to FIG. 12, in a side view and in section along the section plane marked XIII-XIII in FIG. 14.
Figure 14:
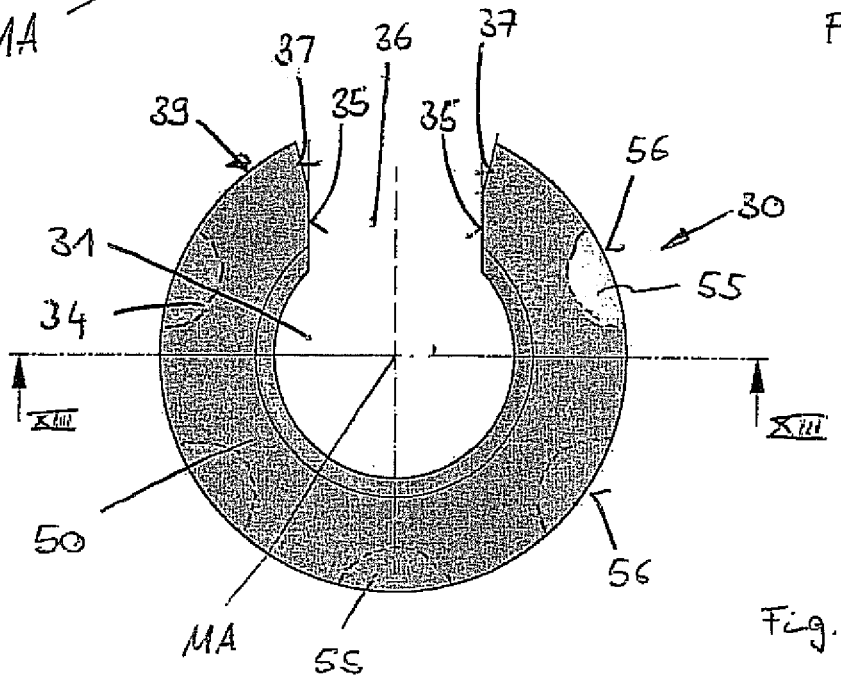
FIG. 14 is a plan view of the securing element according to FIG. 13.

FIGS. 12 to 14 show an alternative variant configuration of the invention. The configuration of shank bit 10 corresponds in terms of its general conformation to shank bit 10 according to FIG. 1. Shank bit 10 according to FIG. 12 can be installed, using securing ring 30 according to FIGS. 13 and 14, in insert 20 of bit holder 40 according to FIGS. 2, 3, and 11. In order to avoid repetition, those configuration features which differ will be discussed below; otherwise reference is made to the statements above.

Shank bit 10 having bit shank 11 and bit head 12 is once again produced as an extruded part or alternatively as a lathe-turned part.

Bit head 12 possesses support segment 12.1 having support surface 12.5. Support segment 12.1 leads via a convex radius transition into support surface 12.5. Support segment 12.1 possesses an outside diameter e in the range between 40 mm and 45 mm. Diameter a of support surface 12.5 is selected in the range between 36 mm and 42 mm. With these diameter relationships, i.e. more generally with a diameter ratio from ≤1 to 1.3 (diameter e/diameter a), considerable deformation is achieved in the region of support segment 12.1 upon cold extrusion. These material deformations result in a particularly tough composite material with good strength properties.

Bit head 12 once again comprises, adjacent to support segment 12.1, a concave taper 12.2 that leads into the frustoconical discharge surface 12.3. A cutting element receptacle 12.4 is formed at the end. A cutting element (13, see above) can be soldered into this.

Support surface 12.5 leads via a frustoconical transition segment into first cylindrical segment 11.1. The extent of first cylindrical segment 11.1 in the direction of longitudinal center axis M is selected to be appreciably shorter than in the exemplifying embodiment according to FIG. 1. Length B is 9 mm in the present case. This represents, with a diameter b of 19.8 mm, a sufficient dimension for road milling applications. With the shortened length of first cylindrical segment 11.1, the axial length of resetting space NR becomes greater. In the present case what results for road milling applications with mixed surfaces (asphalt and concrete) is a particularly suitable wear length of approx. 15 mm to 18 mm for resetting space NR.

Second cylindrical segment 11.3 has an extent D in the direction of longitudinal center axis M of 21.6 mm, and thus holds securing receptacle 11.4 at a spacing from support surface 12.5 sufficient for road milling applications. Diameter c of second cylindrical segment 11.3 is 16.5 mm.

Securing receptacle 11.4 is embodied with a width F of 4.5 mm, consequently somewhat wider than in FIG. 1 and coordinated with securing element 30 according to FIGS. 13 and 14.

The end-located shoulder 11.5 has a thickness of 3 mm and is thus sufficiently stable for road milling applications.

The conformation of securing element 30 will be discussed in further detail below with reference to FIGS. 13 and 14.

Securing element 30 comprises the stamped and bent part shown in FIGS. 7 to 10 as a basic member, with the difference that recesses 34 are not cut in as far as clamping part 32. Reference is made to the statements above regarding the features that are otherwise identical.

This base member is equipped on its surface with a layer 50 that has a lower hardness than the base member. In the present case layer 50 is made of a plastic material. In a particularly preferred application, layer 50 is made of a plastic material, from polyurethane or a composite material containing polyurethane. For reasons of production simplification and in order to create an intimate bond with the base member, layer 50 is molded onto the base member using the injection molding process.

Layer 50 comprises two coating regions 51 and 54. Coating regions 51, 54 are arranged respectively on the concavely curved upper and the convex undersides of the base member. In the region of recesses 34, coating regions 51, 54 are interconnected via connecting segment 55 in such a way that recesses 34 are completely filled up. The radially externally located curved regions of layer 50 thus transition flush into the convex curved regions of holding segments 39. Layer 50 can also project radially beyond holding segments 39.

Radially outer contact segments 56 are formed with the layer regions that fill up recesses 34. These segments abut internally against second diameter region 23 of insert 20. This produces here a friction surface pairing that introduces, in the direction of the longitudinal center axis, an additional frictional resistance that counteracts a pulling-out motion in that direction. The retention of shank bit 10 in insert 20 is thereby improved.

As is evident from FIG. 13, the radially externally located regions of holding segments 39 remain exposed, so that their function as described above is maintained. In addition, introduction chamfers 37 and rims 35 remain uncoated, so that the guidance function upon installation in cutting element receptacle 12.4 is maintained. Inside diameter 38.1 is furthermore also exposed and forms, with the groove base of securing receptacle 11.4, a wear-resistant and permanently accurately fitted rotary bearing system.

The two coating regions 51 and 54 respectively constitute bearing surfaces 52, 53 that proceed in the form of a partial ring around the longitudinal center axis of securing element 30. The two bearing surfaces 52, 53 extend radially and are parallel to one another. They serve for abutment against the groove walls of securing receptacle 11.4, in which context the axial clearance described above must be complied with. In order to achieve tilt-free operation, the axial clearance should be selected in the range between ≥0.2 mm and ≤4 mm. The two bearing surfaces 52, 53 complete the accurately fitted rotary bearing system. Layer 50 increases the stiffness, in particular the torsional strength of the base member, so that this stiff composite member reliably retains shank bit 10.

The invention claimed is:

1. A tool system, comprising:

a bit holder including a bit receptacle, the bit receptacle including a first diameter region, a second diameter region, and a receptacle transitional segment between the first diameter region and the second diameter region; and a bit including a bit shank having a longitudinal center axis, the bit including a first cylindrical segment, a second cylindrical segment, and a shank transitional segment between the first cylindrical segment and the second cylindrical segment;

wherein the receptacle transitional segment and the shank transitional segment are spaced from one another in the direction of the longitudinal center axis to form a resetting space having a length in a range of from 4 mm to 20 mm;

wherein the first cylindrical segment of the bit shank has a diameter in a range of from 18 mm to 30 mm, and a length in the direction of the longitudinal center axis less than or equal to 30 mm; and a securing element disposed about the bit shank and slidable for the entire length of the resetting space in the direction of the longitudinal center axis along a slide guide of the bit receptacle.

2. The tool system of claim 1, wherein:

the bit holder includes an abutting surface; and the bit includes a bit head including a support surface indirectly or directly braced on the abutting surface.

3. The tool system of claim 1, wherein:

the spacing between the receptacle transitional segment and the shank transitional segment is in a range of from 7 mm to 20 mm.

4. The tool system of claim 1, wherein:

the bit holder includes an inner receptacle and an insert received in the inner receptacle, the insert being formed of a material harder than the bit holder, and the insert having the bit receptacle defined therein.

5. The tool system of claim 1, wherein:

at least one of the first and second cylindrical segments of the bit shank is closely received within the first and second diameter regions, respectively, of the bit receptacle such that a rotary bearing and the slide guide in the direction of the longitudinal center axis is provided.

6. The tool system of claim 1, wherein:

the slide guide is defined by one of the first and second diameter regions of the bit receptacle.

7. The tool system of claim 1, wherein the securing element comprises:

a bearing receptacle;

a resilient clamping part at least partially surrounding the bearing receptacle; and a plurality of fastening segments circumferentially spaced from one another and extending radially outward from the clamping part.

8. The tool system of claim 1, wherein:

the bit shank terminates at a free end; and the bit holder includes an opening segment adjacent to the bit receptacle, the opening segment receiving the free end of the bit shank so that the free end can reset into the opening segment.

9. The tool system of claim 8, wherein:

the bit holder includes an insert having the bit receptacle defined therein; and the opening segment of the bit holder is defined adjacent to the insert.

10. The tool system of claim 8, wherein:

the opening segment comprises a drive-out opening accessible from a back side of the bit holder.

11. The tool system of claim 1, wherein:

the bit holder includes an insertion projection configured for replaceable installation in a base part.

12. A tool system, comprising:

a bit holder including a bit receptacle, the bit receptacle including a first diameter region, a second diameter region, and a receptacle transitional segment between the first diameter region and the second diameter region; and a bit including a bit shank having a longitudinal center axis, the bit including a first cylindrical segment, a second cylindrical segment, and a shank transitional segment between the first cylindrical segment and the second cylindrical segment;

wherein the receptacle transitional segment and the shank transitional segment are spaced from one another in the direction of the longitudinal center axis to form a resetting space, the resetting space having a length in the direction of the longitudinal center axis in a range of from 7 mm to 20 mm.

13. The tool system of claim 12, wherein:

the length of the resetting space is in a range of from about 15 mm to about 18 mm.

14. The tool system of claim 12, wherein:

the second cylindrical segment of the bit shank has a length at least 4 mm greater than the length of the resetting space.

15. The tool system of claim 12, wherein:

the first cylindrical segment of the bit shank has a diameter in a range of from 18 mm to 30 mm.

16. The tool system of claim 12, wherein:

the first cylindrical segment of the bit shank has a length in the direction of the longitudinal center axis less than or equal to 30 mm.

17. The tool system of claim 12, wherein:

the bit holder includes an inner receptacle and an insert received in the inner receptacle, the insert having the bit receptacle defined therein, the insert including an abutting surface; and the bit includes a bit head including a support surface indirectly or directly braced on the abutting surface, the support surface being formed of a material softer than the abutting surface, so that wear between the support surface and the abutting surface due to rotation of the bit in the bit holder occurs primarily on the support surface so that the bit recedes into the resetting space.

18. The tool system of claim 12, wherein:

at least one of the first and second cylindrical segments of the bit shank is closely received within the first and second diameter regions, respectively, of the bit receptacle such that a rotary bearing and a slide guide in the direction of the longitudinal center axis is provided.

* * * * *